US012082717B1

(12) United States Patent
McAndrew

(10) Patent No.: US 12,082,717 B1
(45) Date of Patent: Sep. 10, 2024

(54) AIR GUIDE BRACKETS FOR REFRIGERATORS

(71) Applicant: Aerofoil Energy Ltd, Cheshire (GB)

(72) Inventor: Paul McAndrew, Cheshire (GB)

(73) Assignee: Aerofoil Energy Limited, Cheshire (GB)

( * ) Notice: Subject to any disclaimer, the term of this patent is extended or adjusted under 35 U.S.C. 154(b) by 0 days.

(21) Appl. No.: 18/120,261

(22) Filed: Mar. 10, 2023

Related U.S. Application Data

(62) Division of application No. 16/995,250, filed on Aug. 17, 2020, now abandoned.

(60) Provisional application No. 62/887,350, filed on Aug. 15, 2019.

(51) Int. Cl.
*A47F 3/04* (2006.01)
*F25D 17/06* (2006.01)
*F25D 23/02* (2006.01)

(52) U.S. Cl.
CPC ..... *A47F 3/0447* (2013.01); *F25D 17/06* (2013.01); *F25D 23/023* (2013.01); *A47F 2003/046* (2013.01)

(58) Field of Classification Search
CPC .. A47F 3/0447; A47F 2003/046; F25D 17/06; F25D 23/023
See application file for complete search history.

(56) References Cited

U.S. PATENT DOCUMENTS 2,387,622 A 10/1945 Tanner
2,822,672 A 2/1958 Dickson et al.
3,084,463 A * 8/1960 Reynolds et al. ..... G09F 3/20 40/564
3,063,252 A 11/1962 Gilbert et al.
3,063,253 A 11/1962 Dickson et al.
3,747,726 A 7/1973 Walter
4,221,443 A 9/1980 Heaney
5,088,607 A 2/1992 Risafi et al.
8,729,429 B2 5/2014 Nuttall et al.
9,370,262 B2 6/2016 Wirth
D777,225 S 1/2017 McAndrew
D824,963 S 8/2018 McAndrew
D854,590 S 7/2019 McAndrew
(Continued)

FOREIGN PATENT DOCUMENTS

CN 101014268 A 8/2007
CN 101031225 A 9/2007
(Continued)

OTHER PUBLICATIONS

Non-Final Office Action for U.S. Appl. No. 17/569,249 dated Jan. 3, 2024, 20 pages.

*Primary Examiner* — Elizabeth J Martin
*Assistant Examiner* — Dario Antonio Deleon
(74) *Attorney, Agent, or Firm* — Cooley LLP

(57) ABSTRACT

Open display refrigerators, commonly used in retail environments, typically include air curtains. It can be desirable to attach air curtain guides to the front edge of shelves within the refrigerator using brackets that are capable of being attached to a ticket strip. The bracket can include teeth oriented in opposite directions that are configured to be received by corresponding grooves of the ticket strip. A screw, cam, or other transverse member can be configured to urge the teeth apart and secure the bracket within the grooves of the ticket strip.

23 Claims, 7 Drawing Sheets

(56) References Cited

U.S. PATENT DOCUMENTS

| | | | | |
|---|---|---|---|---|
| 11,737,584 | B2 | 8/2023 | McAndrew | |
| 2005/0217297 | A1 | 10/2005 | Wilson | |
| 2006/0059934 | A1 | 3/2006 | Howington et al. | |
| 2007/0251253 | A1 | 11/2007 | Alahyari et al. | |
| 2008/0205040 | A1 | 8/2008 | Shibusawa et al. | |
| 2008/0236182 | A1 | 10/2008 | Hahn et al. | |
| 2012/0092350 | A1 | 4/2012 | Ganapathi et al. | |
| 2013/0112634 | A1 | 5/2013 | Nagel | |
| 2016/0302591 | A1 | 10/2016 | McAndrew | |
| 2017/0231403 | A1* | 8/2017 | Eget et al. ..... | A47F 3/0447 454/192 |
| 2018/0325284 | A1 | 11/2018 | McAndrew et al. | |
| 2019/0142186 | A1 | 5/2019 | Wirth | |
| 2019/0195552 | A1 | 6/2019 | Roesch et al. | |
| 2019/0274452 | A1 | 9/2019 | McAndrew | |
| 2019/0360738 | A1 | 11/2019 | McAndrew | |
| 2021/0298492 | A1 | 9/2021 | Wirth | |
| 2021/0393052 | A1 | 12/2021 | McAndrew et al. | |
| 2022/0175155 | A1 | 6/2022 | McAndrew | |
| 2022/0232999 | A1 | 7/2022 | McAndrew | |
| 2023/0404293 | A1 | 12/2023 | McAndrew | |

FOREIGN PATENT DOCUMENTS

| | | | |
|---|---|---|---|
| CN | 109561769 | A | 4/2019 |
| EP | 0441357 | A2 | 8/1991 |
| EP | 0722158 | B1 | 4/1999 |
| EP | 1120069 | A1 | 8/2001 |
| FR | 2690825 | A1 | 11/1993 |
| FR | 2764787 | A1 | 12/1998 |
| GB | 249295 | A | 3/1926 |
| GB | 2527636 | A | 12/2015 |
| GB | 2541996 | A | 3/2017 |
| GB | 2555227 | A | 4/2018 |
| GB | 2560932 | A | 10/2018 |
| GB | 2563407 | A | 12/2018 |
| GB | 2571116 | A | 8/2019 |
| JP | S5072330 | A | 6/1975 |
| JP | S51150569 | U | 12/1976 |
| JP | S5374768 | U | 6/1978 |
| JP | S55165468 | A | 12/1980 |
| JP | S57152073 | U | 9/1982 |
| JP | S58110977 | A | 7/1983 |
| JP | S59174588 | U | 11/1984 |
| JP | S62162569 | U | 10/1987 |
| JP | 2004278865 | A | 10/2004 |
| JP | 2010207564 | A | 9/2010 |
| JP | 2010207565 | A | 9/2010 |
| JP | 2011131036 | A | 7/2011 |
| JP | 2011167384 | A | 9/2011 |
| JP | 2014198069 | A | 10/2014 |
| KR | 19990013134 | U | 4/1999 |
| KR | 20110092935 | A | 8/2011 |
| KR | 20120008561 | A | 2/2012 |
| WO | WO-2005023060 | A1 | 3/2005 |
| WO | WO-2008052721 | A1 | 5/2008 |
| WO | WO-2012112115 | A1 | 8/2012 |
| WO | WO-2014167320 | A1 | 10/2014 |
| WO | WO-2018200997 | A1 | 11/2018 |
| WO | WO-2019227119 | A1 | 12/2019 |
| WO | WO-2020229799 | A1 | 11/2020 |
| WO | WO-2021005335 | A1 | 1/2021 |

* cited by examiner

AIR GUIDE BRACKETS FOR REFRIGERATORS

RELATED APPLICATIONS

This application is a divisional of U.S. patent application Ser. No. 16/995,250, filed on Aug. 17, 2020, which claims priority to U.S. Provisional Application No. 62/887,350 filed on Aug. 15, 2019, the entirety of each of which is hereby incorporated by reference.

TECHNICAL FIELD

Embodiments described herein relate to open display refrigerators, and in particular to brackets for attaching an air curtain guide to a ticket strip of open display refrigerators.

BACKGROUND

Open display refrigerators are commonly used in retail environments, such as supermarkets, to store and display products, such as meat and dairy products, which must be kept at lower than ambient temperatures. The open front of such a refrigerator makes it easy for customers to view the products being displayed and to retrieve products they wish to purchase from the refrigerator.

This type of refrigerator typically has an air curtain, which is established by blowing cold air across the front of the refrigerator. The air curtain issues from an air outlet at the top of the refrigerator towards an air inlet at the bottom of the refrigerator. The air inlet recovers air from the air curtain and recirculates it to the air outlet via a cooling heat exchanger and fan.

Generally, it is intended that the air curtain follows a broadly linear path from the air outlet to the air inlet thereby preventing cold air in the refrigerator from mixing with warm air exterior to the refrigerator. However, such an air curtain is rather inefficient, in particular because the air curtain tends to spill out from the bottom of the refrigerator and warm air from the exterior becomes entrained into the air curtain. To ameliorate this problem of inefficiency, air guides fixed on the front edge of shelves in the refrigerator can be used to help constrain the air curtain within a desired region.

While it may be possible to custom fabricate air guides to existing refrigerators, such work is likely to be time consuming and/or expensive. A need therefore exists for brackets that are capable to being attached to existing structures common in open display refrigerators, which can allow fast and cost-effective retrofitting of air guides.

DETAILED DESCRIPTION

Figure 1:
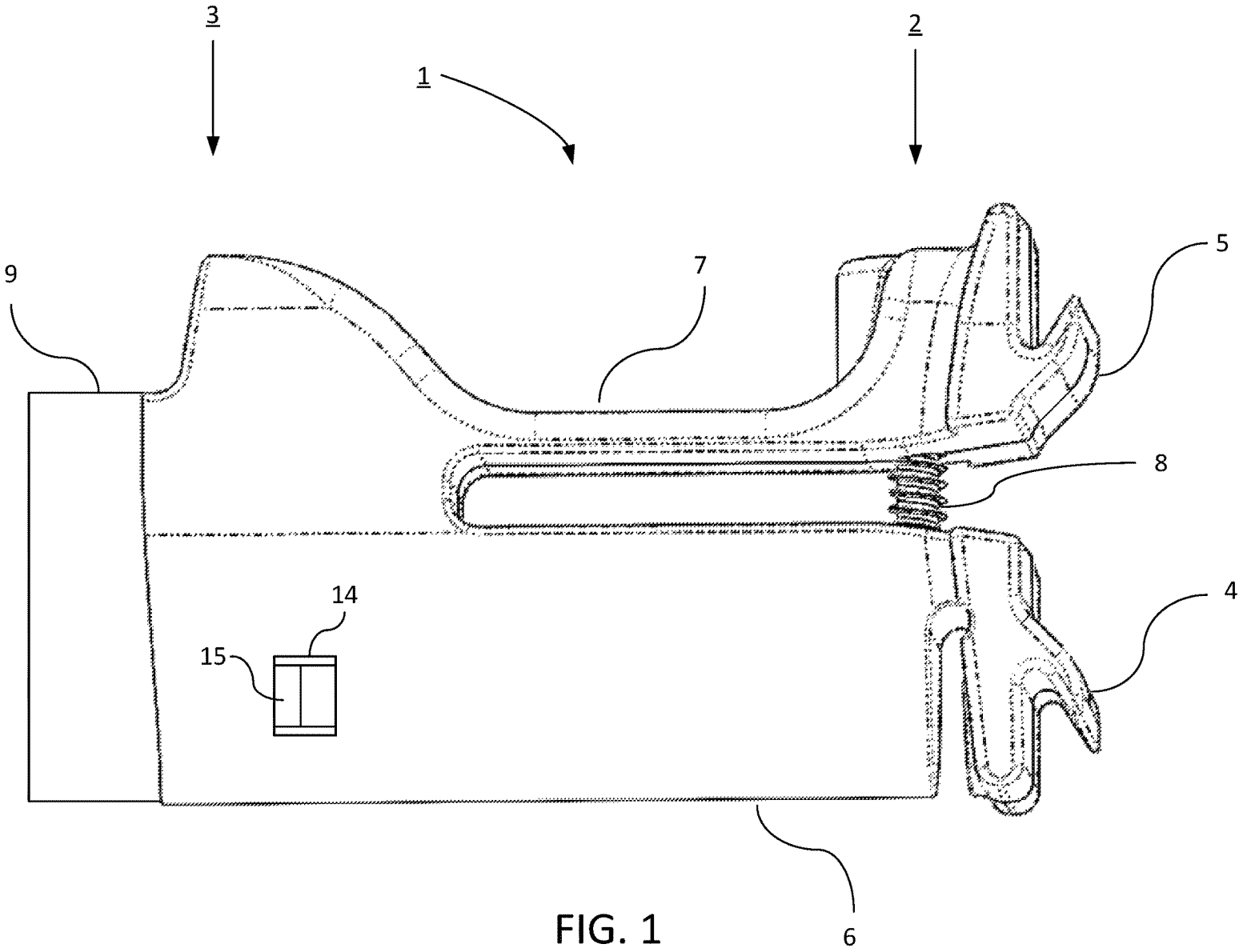
FIG. 1 shows a bracket for attaching an air curtain guide to a ticket strip, according to an embodiment.

Some embodiments described herein relate to a bracket for attaching an air curtain guide to a ticket strip. The bracket can include a first end configured to attach to and/or engage with the ticket strip. A second end of the bracket can be configured to receive or be coupled to an air curtain guide. For example, an air curtain guide can be coupled to the second end of the bracket by one or more screws, bolts, rivets, clips, and/or an adhesive.

Open front display refrigerators frequently have a ticket strip, which is typically attached to the outer edge of a refrigerator shelf (e.g., the edge of the shelf closest to the refrigerator air curtain). A ticket strip typically comprises two opposing grooves, in between which tickets displaying the price of items located on the refrigerator shelf are displayed. The opposing grooves typically run in parallel. A ticket is typically flexible (e.g., paper, thin plastic, laminated paper, an electrophoretic display, etc.), such that the distance between two opposing, parallel edges of the ticket can be brought together to allow the ticket to be inserted in-between the two grooves of the ticket strip. Once the ticket is in place, the natural resilience of the ticket causes it to expand and hence engage with the edges of the grooves.

In some embodiments, the bracket includes a first clip having a first engagement end or tooth and a first body. The first engagement end can be configured to be disposed in a first groove of a ticket strip. The first body can be the portion of the first clip that is directly coupled to the first engagement end. The first body and the first engagement end can be separate structures or monolithically formed. The first clip can be coupled to the second clip via the first body and the second body. The first body and the second body can be separate structures or monolithically formed. The second clip can be opposite the first clip and have a second engagement end or tooth configured to be disposed in a second groove of the ticket strip. In some embodiments, at least one of the first body or the second body can flexible and resilient, which enables the first body and/or the second body to elastically deform such that distance between the first engagement end and the second engagement end can be educed when an inward force is applied to one of the first flexible body and the second flexible body. The distance between the first engagement end and the second engagement end can recover, or return to an unbiased configuration, when the inward force is removed due to the at least one of the first body and the second body being resilient. Additionally, if an outward force is applied to at least one of the first body or the second body, the distance between the first engagement end and the second engagement end can increase.

The first engagement end and the second engagement end may be positioned and shaped to engage with the respective first groove and second groove of the ticket strip in use. When an inward force (e.g., squeeze) is applied, the distance between the first and second engagement ends is reduced and the first and second engagement ends can be inserted in the gap between the grooves of the ticket strip. When the force is removed, the distance between the first and second engagement ends increases and the first and second engagement ends may be received in the respective grooves of the ticket strip, in some embodiments, holding the bracket in place.

In some embodiments, the bracket the first clip and the second clip can be attached to a hinge. The hinge may be in addition to or instead of at least one of the first and second bodies being flexible and resilient. Similarly stated, the hinge can be mechanical hinge that allows a portion of the first body to rotate relative the a portion of the second body, or the hinge can be monolithically formed with the first and second clip and permit elastic and/or plastic deformation such that the first clip and second clip can move relative to each other. The hinge may allow the bracket to operate in a similar manner as to that previously described; however, in order to increase the distance between the first and second engagement ends, the force applied in the first and second directions may be reversed (e.g., outward, instead of inward). The hinge may further comprise a spring, for urging the first and second attachment ends apart, thereby allowing the distance between the first and second engagement ends to recover in a similar manner to a bracket comprising at least one flexible and resilient body.

In some embodiments, the bracket can include a transverse member configured to urge the first clip and the second clip (and therefore the first engagement end and second engagement end) apart. For example, the transverse member can be a threaded member, such as a screw or bolt. Alternatively, the transverse member can be a cam. In yet other embodiments, the transverse member can a spring, a wedge, a block a shim, a post, a bearing, a gear, a cog, or any other suitable device or structure configured to be at least partially disposed between the first clip and the second clip and operable to prevent the first clip and the second clip from moving inward towards each other and/or applying a force to urge the first clip and the second clip (and therefore the first engagement end and the second engagement end) apart.

The first clip can define a threaded configured to receive a threaded member. The threaded member can be tightened such that a tip of the threaded member comes into contact with and exerts a force on a surface of the second clip, thereby locking the first engagement end and the second engagement end in place. Once the threaded member is engaged with a surface of the second body, continuing to turn the threaded member may increase the distance between the first and second engagement ends. Once the threaded member is engaged with a surface of the second body, this essentially prevents the distance between the engagement ends from being decreased. Turning the threaded member in a second direction may allow the distance between the first and second engagement ends to be decreased, when a force is applied to one or both of the first and second flexible bodies.

In use, once the first and second engagement ends of the bracket are engaged with the first and second grooves of the ticket strip, the threaded member may be used to prevent the distance between the first and second engagement ends from being reduced, thereby locking the first engagement end and the second engagement end in place and holding the bracket in place on the ticket strip.

In an alternative embodiment, instead of a threaded hole and a threaded member, the transverse member can be a cam. The bracket can include a slot through the second clip configured to receive the cam. When the cam is received by the second clip, the cam be configured to rotate on an axis defined by the slot, and a surface of the cam can be in sliding contact with the first clip. The cam can be rotated to exert an outward force on the first clip and the second clip (and therefore the first engagement end and second engagement end). The cam can include a handle that is lockably engageable with a handle receiving portion of the slot in the second clip, thereby locking the first engagement end and the second engagement end in place (e.g., in an expanded configuration).

In some embodiments, the bracket is constructed from a plastic and/or a metal. Alternatively the bracket is constructed from a composite material, such as carbon fiber. The bracket may be constructed of any other suitable material. The bracket may comprise any combination of these materials or any other material known in the art.

In some embodiments, the bracket is a first bracket, and an end portion of the bracket opposite the first and second engagement ends of the bracket is configured to receive a second bracket. The second bracket coupled to or configured to be coupled to an air curtain guide.

The end portion of the first bracket opposite the first and second engagement ends can include a recess configured to receive the second bracket. The first bracket can define a hole configured to receive a tab of the second bracket. When the tab is urged outwardly (for example, by the natural resilience of the tab) and is received in the hole, the tab may effectively lock the second bracket into place in the recess. The air curtain guide may be coupled to the second bracket by one or more screws, bolts, rivets, clips, and/or an adhesive.

The air curtain guide, in some embodiments, can be an airfoil. An airfoil is a type of air guide that guides air in a specific manner. An airfoil works by being situated in the air curtain of the refrigerator, with a portion of the air curtain flowing either side of the airfoil. The airfoil imparts a shape into the airflow and guides the airflow in a desired direction. The specific shape of the airfoil causes a change in the direction of flow of the air curtain as it flows over the airfoil. A typical design of airfoil that can be used is a cambered airfoil. This will usually be oriented with the leading edge uppermost and the cambered surface facing away from the interior space. An airfoil is a shape that gives rise to lower pressures on one side (on the suction surface) compared with the other side (on the pressure surface) when placed in the air curtain.

Some embodiments described herein relate to a method of coupling a bracket to a ticket strip that is coupled to a shelf of a refrigerator. The bracket can be coupled to or configured to be coupled to an air guide. The bracket can have a first engagement end (or tooth) and a second engagement end (or tooth). The bracket can be coupled to the air guide strip by disposing the first engagement end in a first groove of the ticket strip and disposing the second engagement in a second groove of the ticket strip. In some embodiments, the first engagement end and the second engagement end can be squeezed together prior to coupling the bracket to the air guide curtain. Similarly stated, the bracket can be configured such that, in an unbiased configuration, the first engagement end and the second engagement are wider than an opening of the ticket strip. The bracket can be locked into the ticket strip in an expanded configuration and/or the unbiased configuration, for example by rotating a cam to spread the first engagement end and the second engagement end in opposite directions or by tightening a screw that is threaded through a first clip of the bracket such that a tip of the screw makes contact with and/or applies a force to a second clip of the bracket, for example, pushing the first engagement end and the second engagement end apart from each other. An air curtain guide (e.g., an airfoil) can be coupled to the bracket.

Embodiments of the invention will now be described with reference to the accompanying drawings, in which:

FIG. 1 shows a bracket 1 configured to attach an air curtain guide to a ticket strip, according to an embodiment. The bracket has a first end 2 configured to engage a ticket strip and a second end 3 configured to be coupled to an air curtain guide. The first end includes a first clip 4 having a first engagement end (or tooth) and a second clip 5 having a second engagement end (or tooth) oriented in an opposite direction to the first engagement end. In use, the first and second engagement ends can be received by and/or disposed in first and second grooves of a ticket strip. The bracket 1 further includes a first flexible and resilient body 6 and a second flexible and resilient body 7. The bracket 1 can further include a hole (e.g., a threaded hole) configured to receive a threaded member 8 (e.g., a screw, bolt, etc.).

As shown, bracket 1 is configured to be coupled to another bracket 9, which can be coupled to or configured to be coupled to an air curtain guide. The second bracket 9 may be received by the bracket 1. The bracket 1 may further comprise a hole 14 for receiving a tab 15 of the second bracket 9. The tab 15 can be used to secure the second bracket 9 in place. When the tab 15 is urged outwardly (for example, by the natural resilience of the tab) and is received in the hole 14, it secures the second bracket 9 in place. It should be understood, however, that in other embodiments, bracket 1 can be directly coupled to or configured to be coupled to an air curtain guide. Similarly stated, the second end 3 can be or include another bracket 9 or be a portion of bracket 1 coupled to or configured to be coupled to an air curtain guide.

Figure 2:
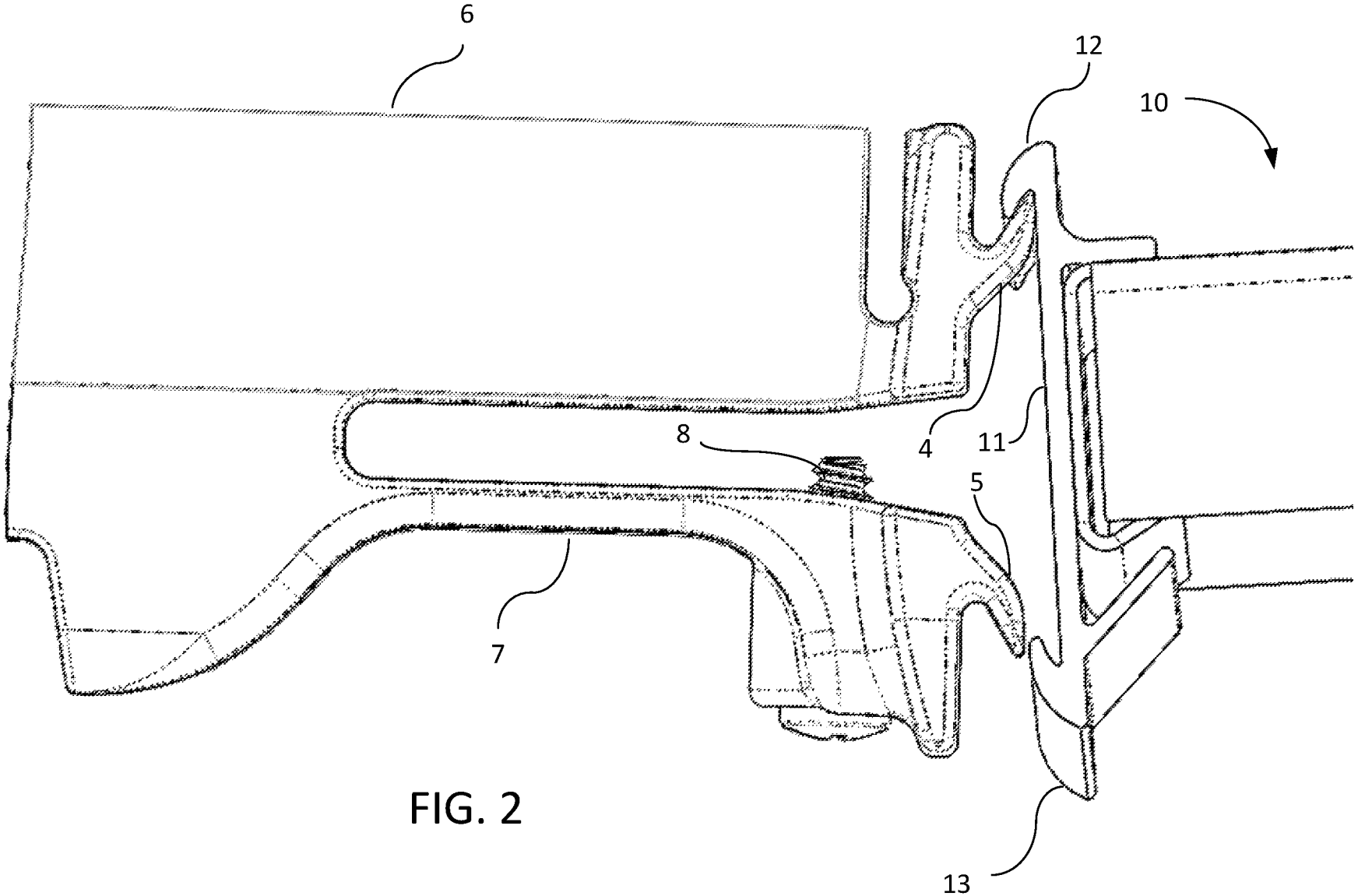
FIG. 2 shows a bracket being attached to a ticket strip, according to an embodiment.

FIG. 2 shows the bracket 1 being attached to a ticket strip 11, according to an embodiment. The ticket strip 11 is attached to the edge of a shelf 10. The shelf 10 may be located in a refrigerator. In use, in some embodiments, inward force(s) are applied to the first flexible and resilient body 6 and a second flexible and resilient body 7 to urge the first engagement end and the second engagement end together (i.e., the first flexible resilient body 6 and/or the second flexible and resilient body 7 can be squeezed together). In instances in which the tips of the first and second engagement ends are wider than the opening to the ticket strip, this can allow the first and second engagement ends to fit in-between the lip of the first and into the first and second grooves 12, 13 of the ticket strip 11.

Figure 3:
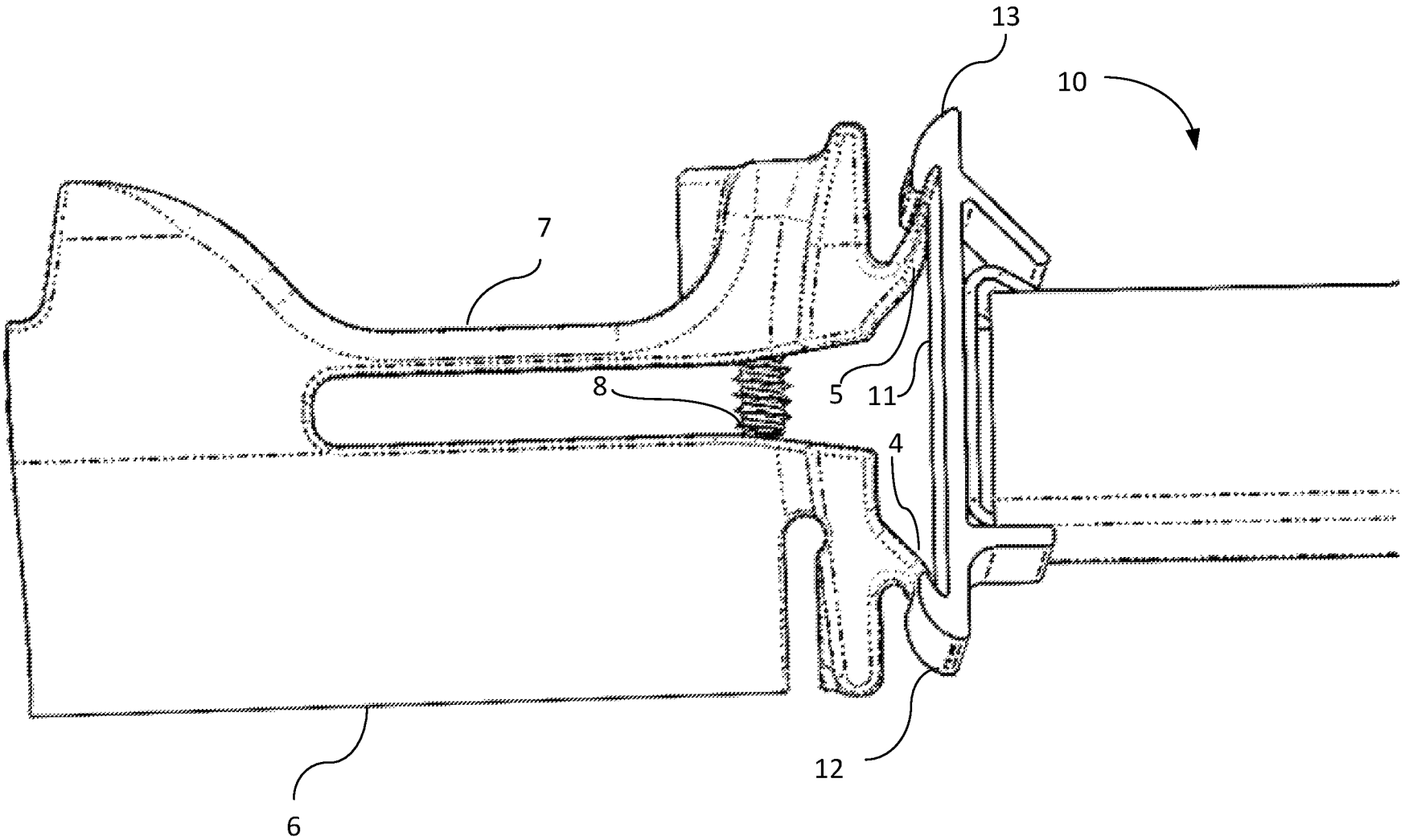
FIG. 3 shows a bracket attached to a ticket strip, but not locked in place, according to an embodiment.

FIG. 3 shows the bracket 1 attached to a ticket strip 11, according to an embodiment. Once the inward force is removed, the resilient and flexible nature of the first and second bodies 6, 7 causes the distance between the first and second engagement ends to increase. This allows the first and second engagement ends to be received in, and grip, the first and second grooves 12, 13 of the ticket strip 11.

It should be understood, however, that in other instances, the first and second engagement ends can fit into the opening of the ticket strip 11 when the bracket 1 is in an unbiased configuration (e.g., when the first flexible resilient body 6 and the second flexible resilient body 7 are not deformed and/or subjected to force). In such an instance, the first and second engagement ends can be expanded into the grooves 12, 13, of the ticket strip by applying an outward force to the first flexible resilient body 6 and/or the second flexible resilient body 7, as discussed in further detail herein.

FIG. 3 further illustrates the bracket 1 locked in place. As compared to FIG. 2, the threaded member 8 has been turned such that it contacts a surface of the second flexible resilient body 7. For example, a drill, wrench, or screwdriver can be used to turn the threaded member 8 in a first direction (e.g., clockwise or tightening direction). By turning the threaded member 8 in a first direction, the amount of the threaded member 8 that protrudes from the first flexible resilient body 6 is increased. By continuing to turn the threaded member 8 in the first direction, the threaded member 8 will eventually contact a surface of the second flexible resilient body 7. The threaded member 8 can apply a force to the first flexible resilient body 6 and/or the second flexible resilient body 7 to urge the engagement ends into the grooves 12, 13 of the ticket strip 11 and/or to prevent or inhibit the engagement ends from being removed from the grooves 12, 13. Once the threaded member 8 is engaged with the surface of the second body 7, the bracket 1 is effectively locked to the ticket strip 11, as the distance between the first and second engagement ends cannot be reduced due to the presence of the threaded member 8.

Figure 4A:
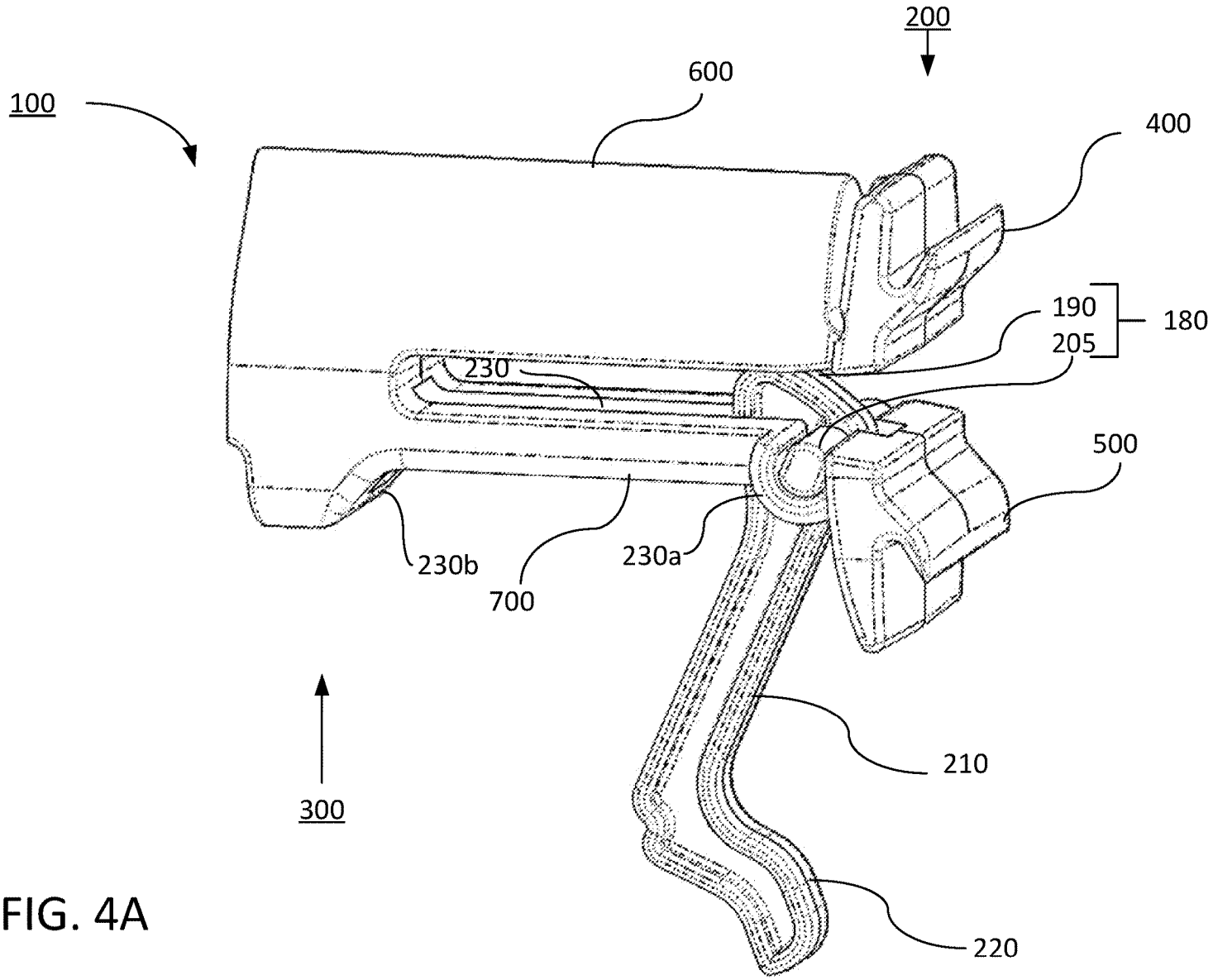
FIGS. 4A and 4B show a bracket for attaching an air curtain guide to a ticket strip, according to an embodiment.
Figure 4B:
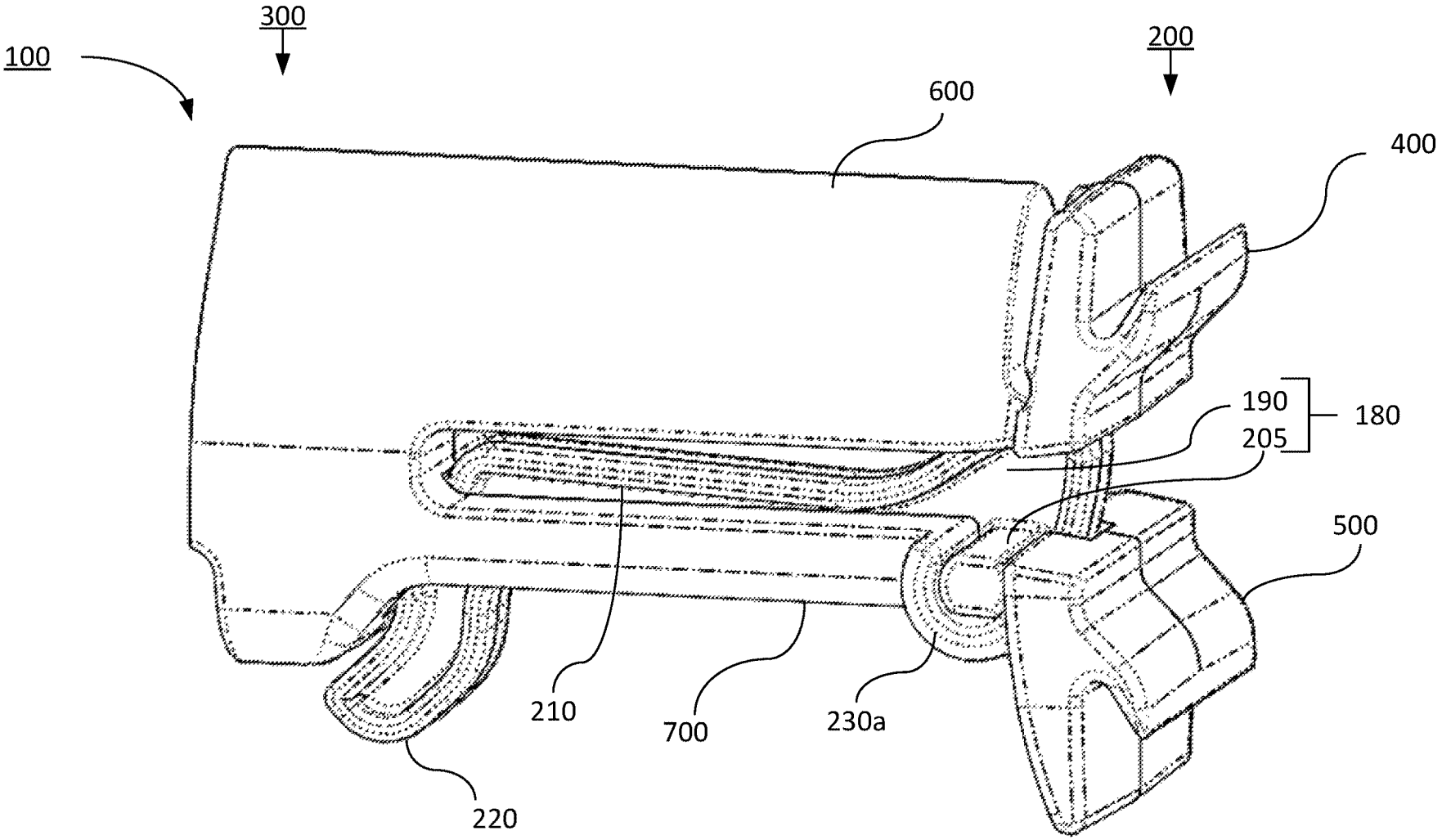

FIGS. 4A and 4B show a bracket 100 configured to attach an air curtain guide to a ticket strip, according to an embodiment. The bracket has a first end 200 configured to engage with a ticket strip and a second end 300 configured to be coupled to the air curtain guide. The first end 200 includes a first clip 400 having a first engagement end (or tooth) and a second clip 500 having a second engagement end (or tooth). In use, the first and second engagement ends may be received in first and second grooves of a ticket strip. The second end 300 can optionally include or be configured to be coupled to another bracket (not shown) that is coupled to or configured to be coupled to the air guide.

The bracket 100 includes a first flexible and resilient body 600 and a second flexible and resilient body 700. The bracket 100 further comprises a cam 180 that includes a cam body 190 and a camshaft 205. A lever 210 is coupled to or a component of the cam 180 and configured to cause the cam 180 to be rotated about an axis defined by the camshaft 205. The lever 210 has a handle 220 configured to allow torque to be applied to the cam 180. The second flexible and resilient body 700 defines a slot 230 for receiving the cam 180 that includes a camshaft engagement portion 230*a* and a handle engagement portion 230*b*. The camshaft 205 is rotatably received in the rod engagement portion 230*a*.

In a first state as shown in FIG. 4A, the cam 180 is positioned such that the lever 210 is outside of the slot 230. The cam body 190 is positioned within the slot 230 such that it exerts minimal or no force on the first flexible and resilient member 600. In use, in some embodiments, inward force(s) are applied to the first flexible and resilient body 600 and a second flexible and resilient body 700 to urge the first engagement end and the second engagement end together (i.e., the first flexible resilient body 600 and/or the second flexible and resilient body 700 can be squeezed together). In instances in which the tips of the first and second engagement ends are wider than the opening to the ticket strip, this can allow the first and second engagement ends to fit in between the lip of the first and second grooves of a ticket strip (not shown in FIG. 4A or 4B). Once the inward force is removed, the resilient and flexible nature of the first and second bodies 600, 700 causes the distance between the first and second engagement ends to increase. This allows the first and second engagement ends to be received in, and grip, the first and second grooves of the ticket strip.

It should be understood, however, that in other instances, the first and second engagement ends can fit into the opening of the ticket strip when the bracket 100 is in an unbiased configuration (e.g., when the first flexible resilient body 600 and the second flexible resilient body 700 are not deformed and/or subjected to force). In such an instance, the first and second engagement ends can be expanded into the grooves of the ticket strip by applying an outward force to the first flexible resilient body 600 and/or the second flexible resilient body 700.

The bracket 100 can be locked into place by moving the lever 210 such that the cam 180 rotates until the handle 220 is brought into engagement with the handle engagement portion 230*b*. As the cam rotates, the cam body 190 is (or is brought into) in sliding contact with the second flexible resilient body 600. The second flexible resilient body 600 follows the cam body 190, such that the cam 180 applies an outward force(s) to the first flexible resilient body 600 and the second flexible resilient body 700 though the cam body 190 and the camshaft 205.

The handle portion 220 can locked into place in the handle engagement portion 230*b*, for example, by way of a snap-fit. In this state (as shown in FIG. 4B). The locking of the handle portion 220 into the handle engagement section 230*b* effectively locks the bracket 100 to the ticket strip (not shown in FIG. 4A or 4B), as the distance between the first and second engagement ends cannot be reduced due to the force exerted by the cam 190.

Figure 5:
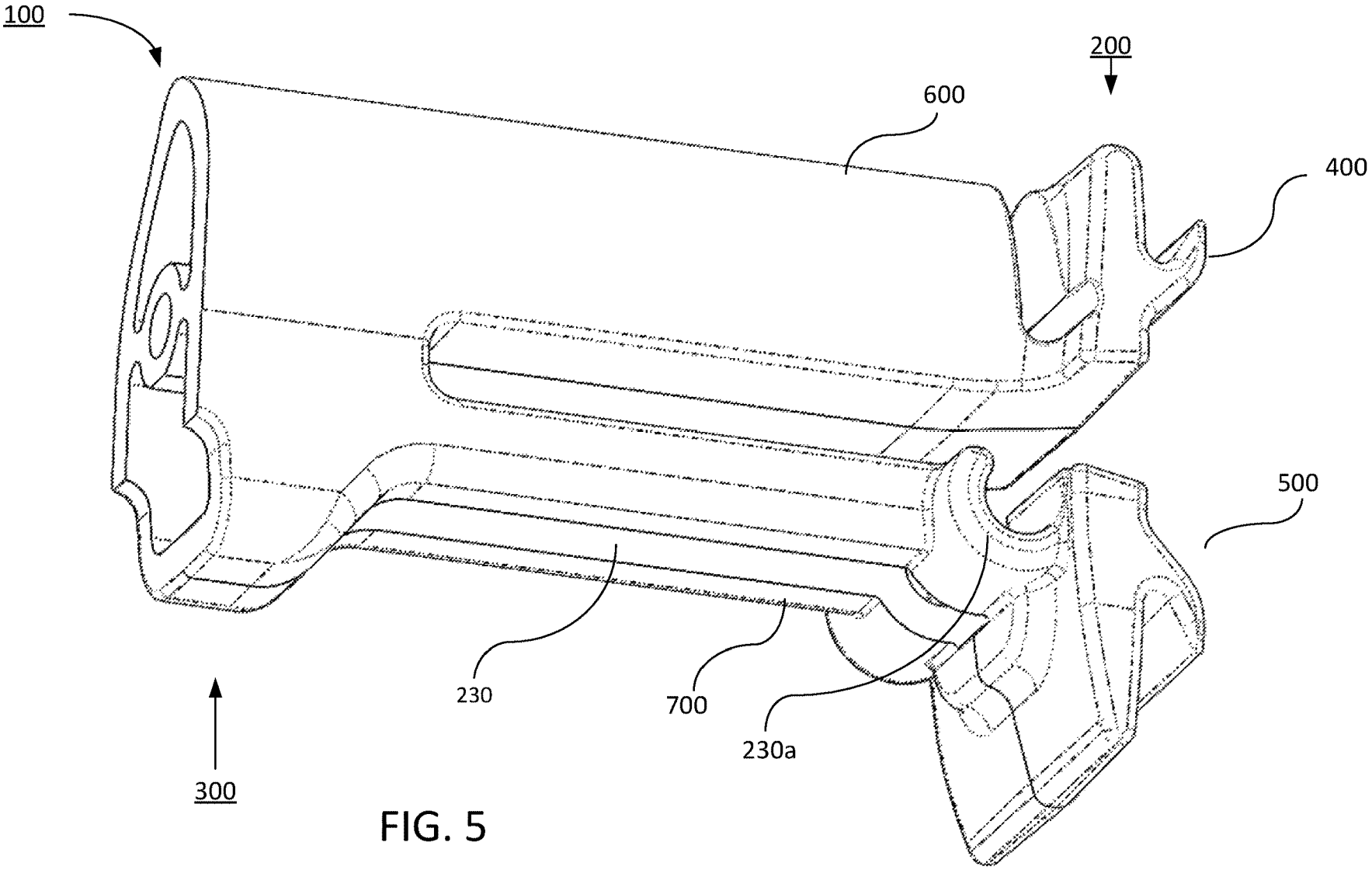
FIG. 5 shows the bracket as illustrated in FIGS. 4A and 4B, without the cam member.

FIG. 5 shows a view of the bracket 100 without the cam member 170.

Figure 6:
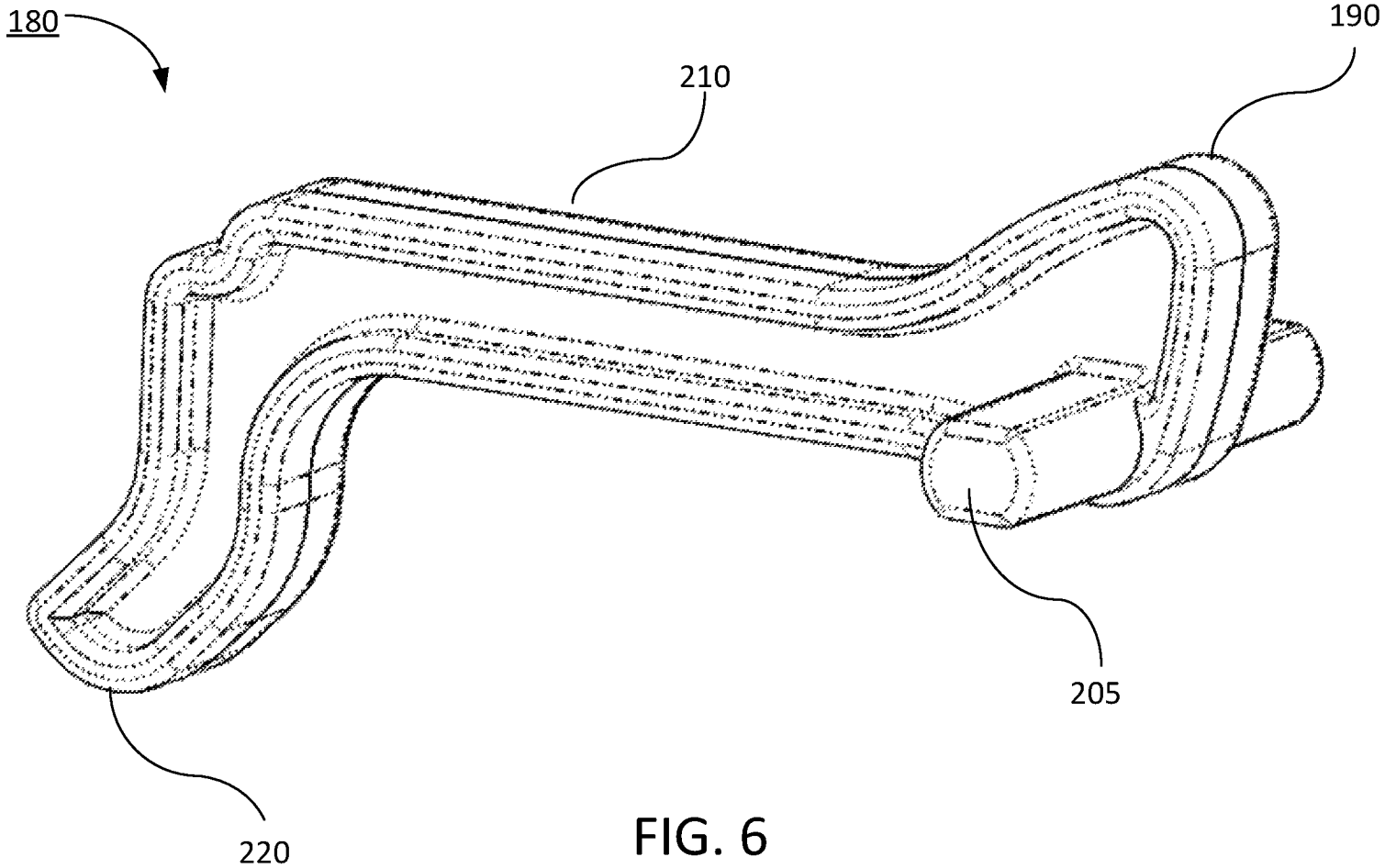
FIG. 6 shows the cam member as illustrated in FIGS. 4A and 4B.

FIG. 6 shows a view of the cam member 180.

While various embodiments have been described above, it should be understood that they have been presented by way of example only, and not limitation. Furthermore, although various embodiments have been described as having particular features and/or combinations of components, other embodiments are possible having a combination of any features and/or components from any of embodiments where appropriate as well as additional features and/or components. Where methods described above indicate certain events occurring in certain order, the ordering of certain events may be modified. Additionally, certain of the events may be performed concurrently in a parallel process when possible, as well as performed sequentially as described above.

What is claimed is:

1. An apparatus, comprising:

a first clip having a first tooth oriented in a first direction, the first tooth configured to be disposed in a first groove of a ticket strip coupled to a shelf of a refrigerator;

a second clip having a second tooth oriented away from the first tooth in a second direction that is opposite the first direction, the second tooth configured to be disposed in a second groove of the ticket strip that is oriented towards the first groove; and a cam configured to selectively engage the first clip to urge the first tooth in the first direction.

2. The apparatus of claim 1, wherein:

a first body portion is directly coupled to the first clip;

a second body portion is directly coupled to the second clip;

the first body portion is coupled to the second body portion; and the second body portion defines a slot configured to receive the cam such that when the cam is disposed in the slot, the cam is selectively engageable with a surface of the first body portion to urge the first tooth in the first direction.

3. The apparatus of claim 1, wherein:

a first body portion is directly coupled to the first clip;

a second body portion is directly coupled to the second clip;

the first body portion is coupled to the second body portion; and the second body portion defines a slot configured to receive the cam such that when the cam is disposed in the slot, the cam is selectively engageable with a surface of the first body portion to urge the first tooth in the first direction; and the second flexible body defines a handle receiving portion configured to lockably engage a handle of the cam when the handle of the cam is engaged with the handle receiving portion, the cam being engaged with the surface of the first body portion.

4. The apparatus of claim 1, wherein the cam selectively engaging the first clip urges the second tooth in the second direction.

5. The apparatus of claim 1, wherein the first clip and the second clip are coupled together via a body of the apparatus.

6. The apparatus of claim 1, wherein:

a body of the apparatus forms a hinge that couples the first clip to the second clip, the hinge configured to elastically deform to allow the first clip to move relative to the second clip; and the cam is configured to selectively urge the hinge towards an open position.

7. The apparatus of claim 1, wherein:

the first clip is directly coupled to a first body portion that is flexible and resilient; and the second clip is directly coupled to a second body portion that is flexible and resilient such that a distance between the first tooth and the second tooth can be reduced when a force is applied to at least one of the first body portion or the second body portion via elastic deformation of at least one of the first body portion or the second body portion.

8. The apparatus of claim 1, wherein:

the cam includes a camshaft portion and a lever;

a first body portion is directly coupled to the first clip;

a second body portion is directly coupled to the second clip;

the first body portion is coupled to the second body portion;

the second body portion defines a first slot configured to receive the camshaft;

the second body portion defines a second slot, a portion of the lever configured to be disposed within the second slot to lock the cam in a position in which the cam engages the first clip to urge the first tooth in the first direction.

9. The apparatus of claim 1, wherein the cam is includes a camshaft oriented orthogonally to the directions the first tooth and the second tooth are urged, the cam configured to be rotated about the camshaft.

10. The apparatus of claim 1, wherein the cam is configured to rotate causing a lobe of the cam to move in sliding contact with the first clip urging the first tooth and the second tooth in opposite directions.

11. A method, comprising:

coupling a bracket having a first tooth and a second tooth to a ticket strip that is coupled to a shelf of a refrigerator such that the first tooth is disposed in a first groove of the ticket strip and the second tooth that is oriented away from the first tooth is disposed in a second groove of the ticket strip that is oriented towards the first groove; and rotating a cam such that the cam contacts a first portion of the bracket that is directly coupled to the first tooth and urges the first tooth and the second tooth in opposite directions.

12. The method of claim 11, further comprising locking the bracket in an expanded configuration such that the first tooth and the second tooth are fixed in the first groove and the second groove, respectively.

13. The method of claim 11, wherein:

a first body portion is directly coupled to the first tooth;

a second body portion is directly coupled to the second tooth; and the first body portion is coupled to the second body portion, the method further comprising:

locking a handle of the cam to a handle receiving portion of the second body portion to lock the bracket in an expanded configuration such that the first tooth and the second tooth are fixed in the first groove and the second groove, respectively.

14. The method of claim 11, wherein:

a body of the bracket forms a hinge that couples the first tooth to the second tooth, the hinge configured to elastically deform to allow the first clip to move relative to the second clip; and rotating the cam urges the hinge towards an open position.

15. The method of claim 11, further comprising:

squeezing the first tooth and the second tooth together prior to coupling the bracket to the ticket strip, when the bracket is released the first tooth configured to be disposed in the first groove and the second tooth configured to be disposed in the second groove.

16. The method of claim 11, wherein:

a body of the bracket forms a hinge that couples the first tooth to the second tooth, the hinge configured to elastically deform to allow the first clip to move relative to the second clip, the method further comprising:

squeezing the body of the bracket to urge first tooth and the second tooth together prior to coupling the bracket to the ticket strip.

17. The method of claim 11, wherein:

a body of the bracket forms a hinge that couples the first tooth to the second tooth, the hinge configured to elastically deform to allow the first clip to move relative to the second clip, the method further comprising:

squeezing the body of the bracket to urge first tooth and the second tooth together prior to coupling the bracket to the ticket strip, the body of the bracket being elastically deformable such that releasing the body of the bracket causes the first tooth and the second tooth to engage the first groove and the second groove, respectively.

18. The method of claim 11, wherein the cam is rotated in a first direction such that the cam contacts a first portion of the bracket that is directly coupled to the first tooth and urges the first tooth and the second tooth in opposite directions, the method further comprising:

rotating the cam in a second direction opposite the first direction to disengage the first portion of the bracket prior to coupling the bracket to the ticket strip.

19. The method of claim 18, wherein the first direction is counterclockwise and the second direction is clockwise.

20. The method of claim 11, a first body portion is directly coupled to the first tooth;

a second body portion is directly coupled to the second tooth; and the first body portion is coupled to the second body portion, the method further comprising:

locking a handle of the cam to a handle receiving portion of the second body portion to lock the bracket in an expanded configuration such that the first tooth and the second tooth are fixed in the first groove and the second groove, respectively.

21. The method of claim 11, wherein the cam is rotated about a camshaft that is oriented orthogonally to the directions the first tooth and the second tooth are urged.

22. The method of claim 11, wherein:

the cam is disposed between the first portion of the bracket and a second portion of the bracket that is directly coupled to the second tooth; and rotating the cam causes a cam body to move in sliding contact with the first portion of the bracket and the second portion of the bracket such that a lobe of the cam urges the first tooth and the second tooth in opposite directions.

23. The method of claim 11, wherein:

the cam includes a camshaft and a lever;

a second body portion is directly coupled to the second tooth;

the first body portion is coupled to the second body portion;

the second body portion defines a first slot configured to receive the camshaft;

the second body portion defines a second slot, the method further comprising:

locking a portion of the lever into the second slot after rotating the cam to maintain the first tooth and the second tooth in an urged apart configuration.

* * * * *